US007975943B1

(12) United States Patent
Culves

(10) Patent No.: US 7,975,943 B1
(45) Date of Patent: Jul. 12, 2011

(54) PILL GRINDER

(76) Inventor: Tonie Culves, Beardstown, IL (US)

( * ) Notice: Subject to any disclaimer, the term of this patent is extended or adjusted under 35 U.S.C. 154(b) by 188 days.

(21) Appl. No.: 12/459,791

(22) Filed: Jul. 9, 2009

Related U.S. Application Data

(63) Continuation-in-part of application No. 10/382,521, filed on Mar. 7, 2003, now abandoned.

(60) Provisional application No. 60/363,755, filed on Mar. 14, 2002.

(51) Int. Cl.
*B02C 23/16* (2006.01)

(52) U.S. Cl. ..... 241/69; 241/DIG. 27

(58) Field of Classification Search ..... 241/69, 241/89.4, 169.1, 169.2, 19.2, DIG. 27
See application file for complete search history.

(56) References Cited

U.S. PATENT DOCUMENTS

| | | | | |
|---|---|---|---|---|
| 568,997 | A | 10/1896 | Trewhella | |
| 3,581,790 | A * | 6/1971 | Conte | 241/88.1 |
| 3,738,596 | A | 6/1973 | Miles | |
| 4,082,230 | A * | 4/1978 | Bounds | 241/92 |
| 4,212,430 | A | 7/1980 | Dale et al. | |
| 4,231,527 | A * | 11/1980 | Bounds | 241/169.1 |
| 4,366,930 | A | 1/1983 | Trombetti, Jr. | |
| 4,591,104 | A | 5/1986 | Bounds | |
| 4,765,549 | A | 8/1988 | Sherman | |
| 4,887,755 | A | 12/1989 | Gibilisco | |
| 4,917,311 | A | 4/1990 | Yoshino et al. | |
| 5,067,666 | A | 11/1991 | Sussman | |
| 5,071,663 | A | 12/1991 | Dugan | |
| 5,531,386 | A | 7/1996 | Jensen | |
| 5,533,683 | A * | 7/1996 | Fay et al. | 241/169 |
| 5,653,161 | A * | 8/1997 | Nopanen et al. | 126/369 |
| 5,782,416 | A * | 7/1998 | Nejatbina | 241/194 |
| 5,904,160 | A | 5/1999 | Wright | |
| 5,950,526 | A * | 9/1999 | Hsu | 99/476 |
| 6,239,338 | B1 | 5/2001 | Robinson | |
| 6,523,766 | B1 * | 2/2003 | Watt | 241/262 |
| 6,637,684 | B1 | 10/2003 | Ross et al. | |
| 6,786,141 | B2 | 9/2004 | Tompa et al. | |

* cited by examiner

*Primary Examiner* — Shelley Self
*Assistant Examiner* — Jennifer Chiang
(74) *Attorney, Agent, or Firm* — Patent & Trademark Services, Inc.; Joseph H. McGlynn

(57) ABSTRACT

An apparatus for grinding pills having a chamber with an abrasive floor and a plurality of blades which will grind pills against the floor. The blades can be electrically or mechanically operated. The floor has a portion open to a lower chamber and which allows the powder to fall into the lower chamber for retrieval. In addition, an implement having a brush on one end and a spoon on the other is included to help remove the powder from the chambers.

6 Claims, 2 Drawing Sheets

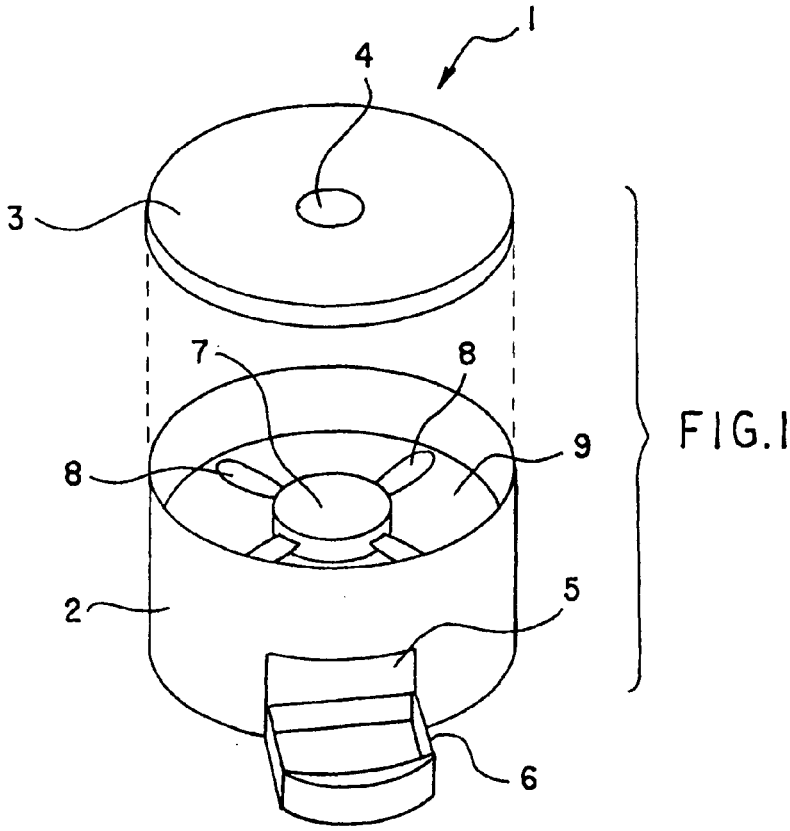
FIG.1
FIG.2
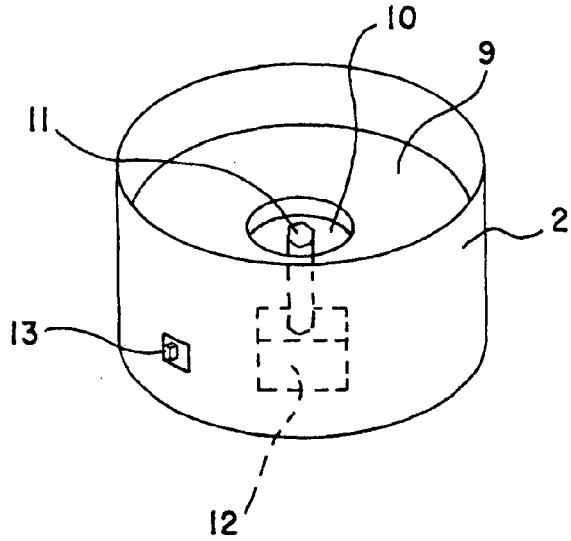

FIG.3
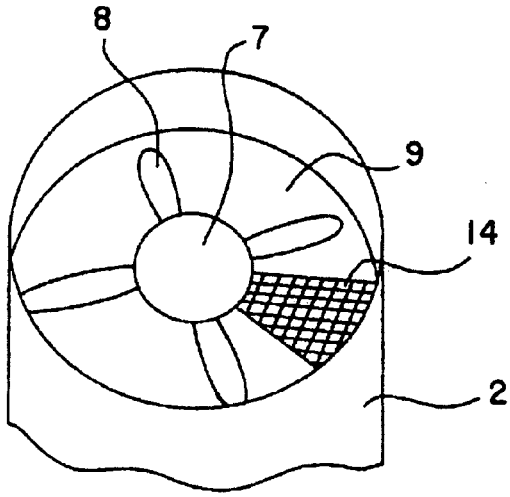
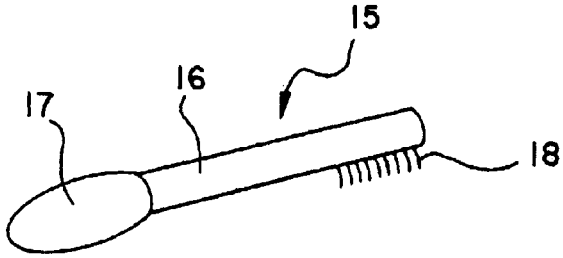
FIG.4
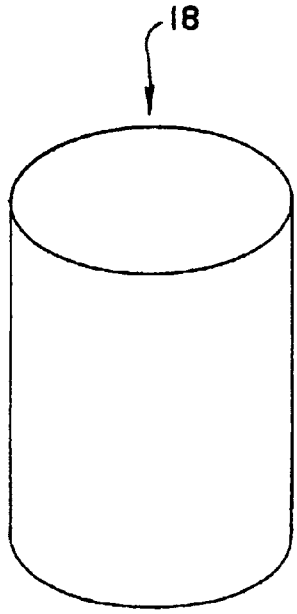
FIG.5

PILL GRINDER

This is a C-I-P of Ser. No. 10/382,521, filed Mar. 7, 2003, now abandoned. Applicant also claims priority of Provisional Ser. No. 60/363,755, filed Mar. 14, 2002.

BACKGROUND OF THE INVENTION

This invention relates, in general, to commutators, and, in particular, to commutators for pills.

DESCRIPTION OF THE PRIOR ART

In the prior art various types of devices have been proposed. For example, U.S. Pat. No. 5,531,386 to Jensen discloses a pill crusher having crushing rollers and a collection tray.

U.S. Pat. No. 4,765,549 to Sherman discloses a pill crusher having a container for storing the pills which also acts as a means to force the pill against a crushing grid.

U.S. Pat. No. 5,067,666 to Sussman discloses a pill crusher which is operated by batteries and which has a collection tray.

U.S. Pat. No. 4,366,930 to Trombetti, Jr. discloses a pill crusher which has a screen against which the pills are crushed.

U.S. Pat. No. 4,887,755 to Gibilisco discloses a pill crusher with a hinged lid for crushing the pills.

SUMMARY OF THE INVENTION

The present invention is directed to an apparatus for grinding pills having a chamber with an abrasive floor and a plurality of blades which will grind pills against the floor. The blades can be electrically or mechanically operated. The floor has a portion open to a lower chamber and which allows the powder to fall into the lower chamber for retrieval. In addition, an implement having a brush on one end and a spoon on the other is included to help remove the powder from the chambers.

It is an object of the present invention to provide a new and improved grinder for pills.

It is an object of the present invention to provide a new and improved grinder for pills which can be manually or electrically operated.

It is an object of the present invention to provide a new and improved grinder for pills which can be easily operated even by handicapped persons.

These and other objects and advantages of the present invention will be fully apparent from the following description, when taken in connection with the annexed drawings.

BRIEF DESCRIPTION OF THE DRAWINGS

FIG. 1 is an exploded perspective view of the apparatus of the present invention.

FIG. 2 is a perspective view of the grinder chamber with the blades removed.

FIG. 3 is a partial perspective view of the present invention showing the floor of the grinding chamber.

FIG. 4 is a perspective view of an implement used with the apparatus of the present invention.

FIG. 5 is a perspective view of a sound deadening cover for the invention.

DESCRIPTION OF THE PREFERRED EMBODIMENT

Referring now to the drawings in greater detail, FIG. 1 shows an exploded perspective view of the grinding apparatus

1 of the present invention. The grinder has a body 2 which, as shown in FIG. 1 is circular, however, other shapes could be used without departing from the scope of the invention. The body 2 has an open top with a cover 3 which can be attached to the open top in any conventional manner in order to secure the cover 3 to the open top. Preferably the cover 3 is transparent so the results of the grinding operation can be viewed without removing the cover. In addition, the cover 3 has an opening 4 so pills can be added to the grinder without taking off the cover.

The body 2 has a grinding chamber with a centrally mounted plate 7 which has a plurality of grinding blades 8 mounted around the circumference of the plate 7. While the preferred number of blades is four, fewer or more blades could be used without departing from the scope of the invention. Also, the specific shape of the blades 8 is not critical as long as the blades will grind up any pills introduced into the grinding chamber.

The body 2 has a drawer 6 which slides into an opening 5 in the side of the body 2. When the pills are ground by the blades 8, the resulting powder will drop through the floor 9 of the grinding chamber, and will fall into the drawer 6 where it can be easily removed. In order to make this task easier, an implement 15, as shown in FIG. 4 can be used. This implement has a spoon shape 17 formed on one end to scoop the powder from the drawer 6, and a brush 18 on the other end to collect the powder.

As shown in FIG. 2, the bottom of the body 2 has a conventional motor 12, a shaft which engages the plate 7 and which will rotate the plate and the blades 8 attached thereto. Also, the body 2 has an on/off switch 13 to control the motor 12. Also, it should be understood that any conventional motor can be used, and it is not critical that the motor runs on AC or DC power. Therefore, the body could have a conventional power cord (not shown) to connect it to a conventional source of AC power, or the motor could be driven by batteries (not shown). In addition, the grinder could be operated manually similar to a pepper grinder.

As shown in the partial perspective view of FIG. 3, the floor 9 of the grinding chamber has at least one section 14 which will allow the powder from the ground pills to fall into the drawer 6 (see FIG. 1). As shown in FIG. 3, the floor section 14 is made as a mesh with apertures which allow the grinding chamber to communicate with the drawer 6. Obviously, the floor section 14 should be located directly above the drawer 6. In addition, due to the nature of the structure of the floor section 14, i.e. mesh with apertures, the surface will form a grinding surface. When the blades 8 force the pills against the grinding surface of floor section 14, the pills will be ground and forced through the mesh into the drawer 6. The area of the mesh material 14 comprises an area which is substantially less than the entire area of the floor 9. This will allow the floor 9 to be made from a material that is not as strong as the material that would be needed if the mesh material 14 were to occupy more than an area which is substantially less than the entire area of the floor 9. This will result in a cost savings in material since the more substantial material will be more costly. The term "substantially" means the mesh material will be only 20%-25% of the floor area 9.

Also, as shown in FIG. 5 a cover 18 could be provided for the grinder. The sleeve 18 is made from a quilted fabric and will act as a sound muffler when placed over the pill grinder while it is working. In addition, the sleeve 18 will also act as a quasi storage container when the product isn't in use.

Although the Pill Grinder and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An apparatus for grinding pills, said apparatus comprising:

a body having a top, bottom and sides connecting said top and bottom, said top having an opening therein, means for closing said open top, and wherein said means for closing said open top is a cover, said cover having an opening therethrough, whereby pills may be introduced into said apparatus without removing said cover, said body having a chamber below said open top, said chamber having a floor, said chamber having a rotatable plate secured therein above said floor, said rotatable plate having means for grinding attached thereto, said body having a second chamber therein, and means for allowing said chamber to communicate with said second chamber, and wherein said means comprises a portion of said floor which is comprised of an area of mesh material, and said area of mesh material comprises an area which is substantially less than an entire area of said floor.

2. The apparatus for grinding pills as claimed in claim 1, wherein said cover is transparent.

3. The apparatus for grinding pills as claimed in claim 1, wherein said means for grinding is a plurality of blades.

4. The apparatus for grinding pills as claimed in claim 1, wherein said second chamber comprises a drawer which can be pulled out from said body.

5. The apparatus for grinding pills as claimed in claim 1, wherein said apparatus includes means for collecting said pills after they have been ground, said means for collecting said pills after they have been ground comprising an element having a first end and a second end, said first end having a spoon, and said second end having a brush.

6. The apparatus for grinding pills as claimed in claim 1, in combination with a sound muffler, and wherein said sound muffler is made from a quilted fabric and placed over said apparatus for grinding pills while the apparatus is grinding.

* * * * *